US008136271B2

(12) United States Patent
Sakai et al.

(10) Patent No.: US 8,136,271 B2
(45) Date of Patent: Mar. 20, 2012

(54) HYDRAULIC UNIT AND CONSTRUCTION MACHINE INCLUDING THE SAME

(75) Inventors: Toshiyuki Sakai, Osaka (JP); Kenichi Kawata, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 81 days.

(21) Appl. No.: 12/598,360

(22) PCT Filed: Apr. 30, 2008

(86) PCT No.: PCT/JP2008/001125

§ 371 (c)(1),
(2), (4) Date: Oct. 30, 2009

(87) PCT Pub. No.: WO2008/136195

PCT Pub. Date: Nov. 13, 2008

(65) Prior Publication Data

US 2010/0115800 A1 May 13, 2010

(30) Foreign Application Priority Data

May 2, 2007 (JP) ..... 2007-121372

(51) Int. Cl.
*E02F 3/43* (2006.01)
*H02P 1/54* (2006.01)

(52) U.S. Cl. ..... 37/348; 318/34

(58) Field of Classification Search ..... 37/348, 37/382, 347; 701/50; 91/358 R; 172/2–12; 60/419–422; 417/43, 213, 274; 318/34, 318/140, 147
See application file for complete search history.

(56) References Cited

U.S. PATENT DOCUMENTS

| | | | | |
|---|---|---|---|---|
| 4,801,247 | A * | 1/1989 | Hashimoto et al. | 417/213 |
| 5,240,380 | A * | 8/1993 | Mabe | 417/43 |
| 5,865,602 | A * | 2/1999 | Nozari | 417/44.1 |
| 5,957,213 | A * | 9/1999 | Loraas et al. | 172/2 |
| 6,374,602 | B1 * | 4/2002 | Prabhu et al. | 60/419 |
| 6,708,787 | B2 * | 3/2004 | Naruse et al. | 180/53.8 |
| 6,725,581 | B2 * | 4/2004 | Naruse et al. | 37/348 |
| 6,989,640 | B2 * | 1/2006 | Yoshimatsu | 318/34 |
| 7,146,808 | B2 * | 12/2006 | Devier et al. | 60/422 |
| 7,207,173 | B2 * | 4/2007 | Nakata et al. | 60/329 |
| 7,562,472 | B2 * | 7/2009 | Tozawa et al. | 37/348 |

(Continued)

FOREIGN PATENT DOCUMENTS

| | | | |
|---|---|---|---|
| JP | 62-130183 | U | 8/1987 |
| JP | 7-71372 | A | 3/1995 |
| JP | 11-293710 | A | 10/1999 |
| JP | 11-336703 | A | 12/1999 |

(Continued)

*Primary Examiner* — Robert Pezzuto
(74) *Attorney, Agent, or Firm* — Birch, Stewart, Kolasch & Birch, LLP

(57) ABSTRACT

A hydraulic unit is switched among a first region A where a flow rate is adjusted by controlling a rotational speed of an electric motor while maintaining a displacement of a variable displacement pump at a maximum value, a second region B where the flow rate is adjusted by changing the displacement of the variable displacement pump while maintaining the rotational speed of the electric motor at a minimum value lower than the rotational speed in the first region A, and a third region C where, in a range where a discharge pressure of the variable displacement pump is larger than that in the first region A, the flow rate is adjusted by changing the rotational speed of the electric motor in a range larger than the minimum rotational speed, while maintaining the displacement of the variable displacement pump at an allowable maximum value that is derived from the discharge pressure and a maximum shaft torque of the electric motor.

4 Claims, 8 Drawing Sheets

U.S. PATENT DOCUMENTS

| | | | | |
|---|---|---|---|---|
| 7,745,947 | B2 * | 6/2010 | Komiyama et al. | 290/40 C |
| 2005/0001567 | A1 | 1/2005 | Yoshimatsu | |
| 2008/0201045 | A1 * | 8/2008 | Kagoshima et al. | 701/50 |
| 2009/0055056 | A1 * | 2/2009 | Ooki et al. | 701/50 |

FOREIGN PATENT DOCUMENTS

| | | | |
|---|---|---|---|
| JP | 2003-155760 | A | 5/2003 |
| JP | 2003-172302 | A | 6/2003 |
| JP | 2006-17195 | A | 1/2006 |

* cited by examiner

HYDRAULIC UNIT AND CONSTRUCTION MACHINE INCLUDING THE SAME

TECHNICAL FIELD

The present invention relates to hydraulic units having a variable displacement pump, and an electric motor capable of controlling its rotational speed, for driving the variable displacement pump, and construction machines including such a hydraulic unit.

BACKGROUND ART

In construction machines such as hydraulic shovels, hydraulic units have been known in which a variable displacement pump is coaxially directly connected to a diesel engine mounted, and a required flow rate is increased and decreased by changing the pump displacement (the discharge amount per rotation) without changing the rotational speed of the engine.

A hydraulic unit, which includes an engine and a variable displacement pump that is driven by the engine, will be described below. It is herein assumed that, in this hydraulic unit, the rated rotational speed of the engine is 2,400 rpm, the variable range of the pump displacement is 0 to 54 cc/rev, the allowable pressure of the pump is 25 MPa, and the constant horsepower mechanism setting of the pump is 20 kW. In this case, as shown in FIG. 7, the discharge amount (the flow rate) of the pump is successively reduced from 130 L/min by reducing the pump displacement from 54 cc/rev while maintaining the rotational speed of the engine at the rated value of 2,400 rpm. Since a change in speed of actuators such as a hydraulic cylinder and a hydraulic motor directly relate to a change in pump flow rate. Thus, the pump flow rate is changed as appropriate according to the operation of the actuators.

For example, Patent Document 1 discloses a control apparatus for a construction machine including an engine, a variable displacement pump that is driven by the engine, and pump output control means for performing control so that the product of a load pressure that is applied to the variable displacement pump and a displacement thereof becomes substantially constant.

Patent Document 1: Japanese Published Patent Application No. H11-293710

DISCLOSURE OF THE INVENTION

Problems to be Solved by the Invention

In conventional hydraulic units, however, in order to change the pump flow rate to change the actuator speed, the pump displacement needs to be changed without changing the rotational speed of the pump, because the rotational speed of the engine cannot be changed instantaneously.

Variable displacement pumps, which are commonly used in construction machines such as hydraulic shovels, are swash plate type axial piston hydraulic pumps. As shown in FIG. 10, in the swash plate type axial piston hydraulic pumps, the pump efficiency decreases by about 10% when the flow rate is reduced by half by reducing the pump displacement by half without changing the rotational speed. Thus, there has been a problem that the efficiency is poor at low flow rates. On the other hand, as shown in FIG. 8, the pump efficiency decreases by only about 2% when the pump flow rate is reduced by half by reducing the rotational speed by half, from 2,400 rpm to 1,200 rpm, without changing the pump displacement. Moreover, in characteristics of electric motors, as shown in FIG. 9, the electric motor efficiency decreases by only about 2% when the pump flow rate is reduced by half by reducing the rotational speed by half, from 2,400 rpm to 1,200 rpm, without changing the shaft torque.

The present invention was developed in view of the above problems, and it is an object of the present invention to improve pump efficiency by appropriately selecting a combination of the rotational speed and the displacement of a pump.

Means for Solving the Problems

The present invention proposes a control method capable of improving efficiency at low flow rates of a hydraulic pump, regarding a series type hybrid shovel which includes, in addition to an engine, an electric generator and an electric motor that is capable of controlling its rotational speed, and which uses all the power of the engine to drive the electric generator, and drives the electric motor with generated electric power to rotate a hydraulic pump directly connected to the electric motor.

In general, the larger the pump displacement is, the higher the efficiency of variable displacement pumps is (FIG. 10). The operation region of a variable displacement pump (38) is divided based on a principle that the pump displacement is maintained as large as possible, and the flow rate is changed by preferentially changing the rotational speed of an electric motor (37) which can be changed instantaneously.

More specifically, a first invention is intended for a hydraulic unit (50) which includes a variable displacement pump (38), and an electric motor (37) capable of controlling its rotational speed, for driving the variable displacement pump (38).

The hydraulic unit (50) includes flow rate adjusting means (51) for switching among a first region A where a flow rate is adjusted by controlling the rotational speed of the electric motor (37) while maintaining a displacement of the variable displacement pump (38) at a maximum value, a second region B where the flow rate is adjusted by changing the displacement of the variable displacement pump (38) while maintaining the rotational speed of the electric motor (37) at a minimum value (lower than the rotational speed in the first region A) capable of maintaining a certain level of hydraulic pump efficiency, and a third region C where, in a range where a discharge pressure of the variable displacement pump (38) is larger than that in the first region A, the flow rate is adjusted by changing the rotational speed of the electric motor (37) in a range larger than the minimum rotational speed, while maintaining the displacement of the variable displacement pump (38) at an allowable maximum value that is derived from the discharge pressure and a maximum shaft torque of the electric motor (37).

According to the above structure, in the first region A, the flow rate is adjusted by changing the rotational speed of the electric motor (37) capable of controlling its rotational speed, while maintaining the displacement of the variable displacement pump (38) at the maximum value that provides the highest efficiency. In the second region B, the flow rate is adjusted by changing the displacement of the variable displacement pump (38) while maintaining the rotational speed of the pump (38) at the minimum value. The third region C is intended for the range where the discharge pressure of the variable displacement pump (38) is larger than that in the first region A, and in the third region C, the flow rate is adjusted by maintaining the displacement of the variable displacement pump (38) at the allowable maximum value that is derived from the discharge pressure and the maximum shaft torque of the electric motor (37) at that time, and changing the rotational speed according to the allowable maximum displacement. This allowable maximum displacement changes in inverse proportion to the discharge pressure. Moreover, the rotational speed of the electric motor (37) in this case is in the range larger than the minimum rotational speed of the second region B.

Thus, the flow rate is adjusted by preferentially changing the rotational speed of the electric motor (37) which can be easily changed, while maintaining the displacement of the variable displacement pump (38) as large as possible, whereby reduction in efficiency of the variable displacement pump (38) can be reliably prevented.

According to a second invention, in the first invention, the control of the rotational speed of the electric motor (37) is performed by inverter control.

According to the above structure, since the rotational speed of the electric motor (37) can be easily changed by the inverter control, the flow rate of the variable displacement pump (38) is easily adjusted while maintaining the displacement of the variable displacement pump (38) at a value that provides high efficiency.

A third invention is a construction machine including the hydraulic unit (50) of the second invention, an engine (31), and an electric generator (32) that is driven by the engine (31). Electric power of the electric generator (32) is supplied to the electric motor (37) through an inverter (34).

According to the above structure, the engine is always operated continuously with a constant output torque and a constant rotational speed to drive the electric generator, regardless of the work load of the shovel and the rotational speed of the engine (31) at that time, and electric power obtained can be easily changed by inverter control and transmitted to the electric motor (37). Thus, the flow rate of the variable displacement pump (38) is easily adjusted while maintaining the displacement of the variable displacement pump (38) at a value that provides high efficiency. Thus, an efficient operation of the variable displacement pump (38) is implemented without reducing the operational capability of actuators of the construction machine.

According to a fourth invention, in the third invention, the construction machine is a hydraulic shovel (1).

According to the above structure, in the hydraulic shovel (1), a multiplicity of actuators are mounted, and the operation speed of the actuators changes frequently, as compared to other construction machines such as crane vehicles. More specifically, an operation of extending and retracting various cylinders is performed frequently, and the turning speed frequently changes from high to low. Since an efficient operation of the variable displacement pump (38) can be implemented in such a hydraulic shovel (1), operation efficiency is improved.

EFFECTS OF THE INVENTION

As described above, according to the first invention, the distribution of the rotational speed and the displacement of the variable displacement pump (38) is divided into the first through third regions, and the flow rate is adjusted by preferentially changing the rotational speed of the electric motor (37) which can be easily changed, so as to maintain the displacement of the variable displacement pump (38) at a value that provides high efficiency. Thus, the efficiency of the variable displacement pump (38) can be maximized.

According to the second invention, the control of the rotational speed of the electric motor (37) is performed by inverter control, whereby the flow rate can be very easily adjusted while maintaining the displacement of the variable displacement pump (38) at a value that provides high efficiency.

According to the third invention, electric power of the electric generator (32) that is driven by the engine (31) of the construction machine is changed through the inverter (34) and supplied to the electric motor (37), regardless of the work load of the shovel and the rotational speed of the engine (31) at that time. Thus, the flow rate can be adjusted while maintaining the displacement of the variable displacement pump (38) at a value that provides high efficiency, whereby operation efficiency of the construction machine can be considerably improved.

According to the fourth invention, the construction machine is the hydraulic shovel (1) in which a multiplicity of actuators are mounted, and the operation speed thereof changes frequently. Thus, the variable displacement pump (38) can be efficiently operated, whereby the operation efficiency is considerably improved.

DESCRIPTION OF CHARACTERS

Figure 1:
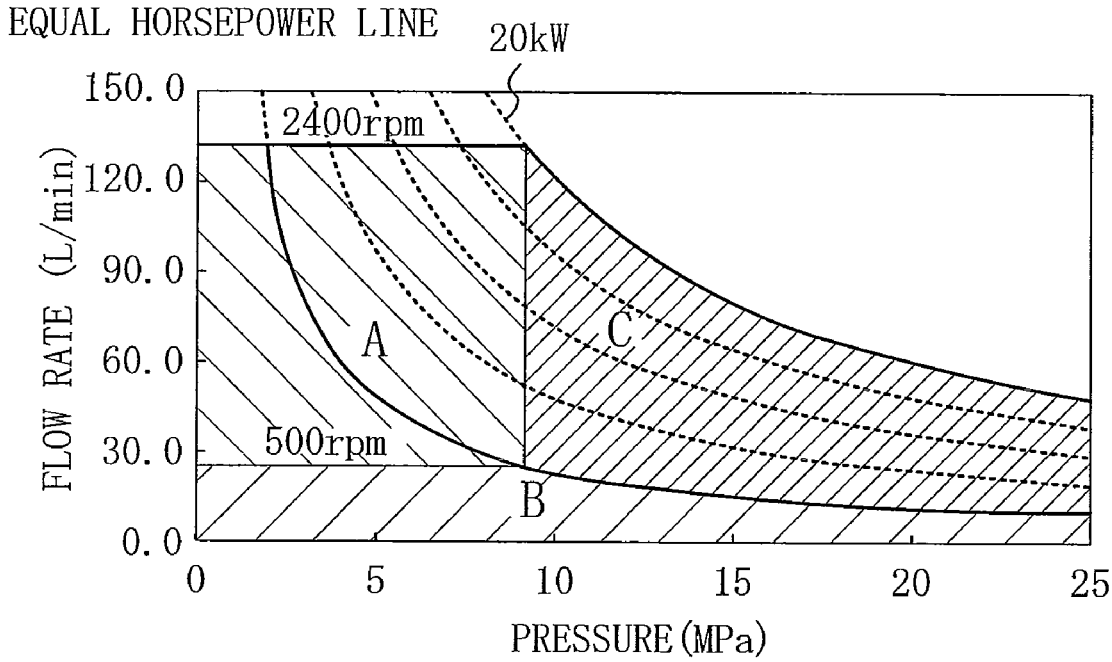
FIG. 1 is a graph showing an efficiency map according to an embodiment of the present invention.

1 hydraulic shovel (construction machine)
31 engine
32 electric generator
34 inverter
37 electric motor
38 variable displacement pump
50 hydraulic unit
51 flow rate adjusting means

BEST MODE FOR CARRYING OUT THE INVENTION

An embodiment of the present invention will be described below with reference to the accompanying drawings.

[Structure of a Hydraulic Shovel]

Figure 2:
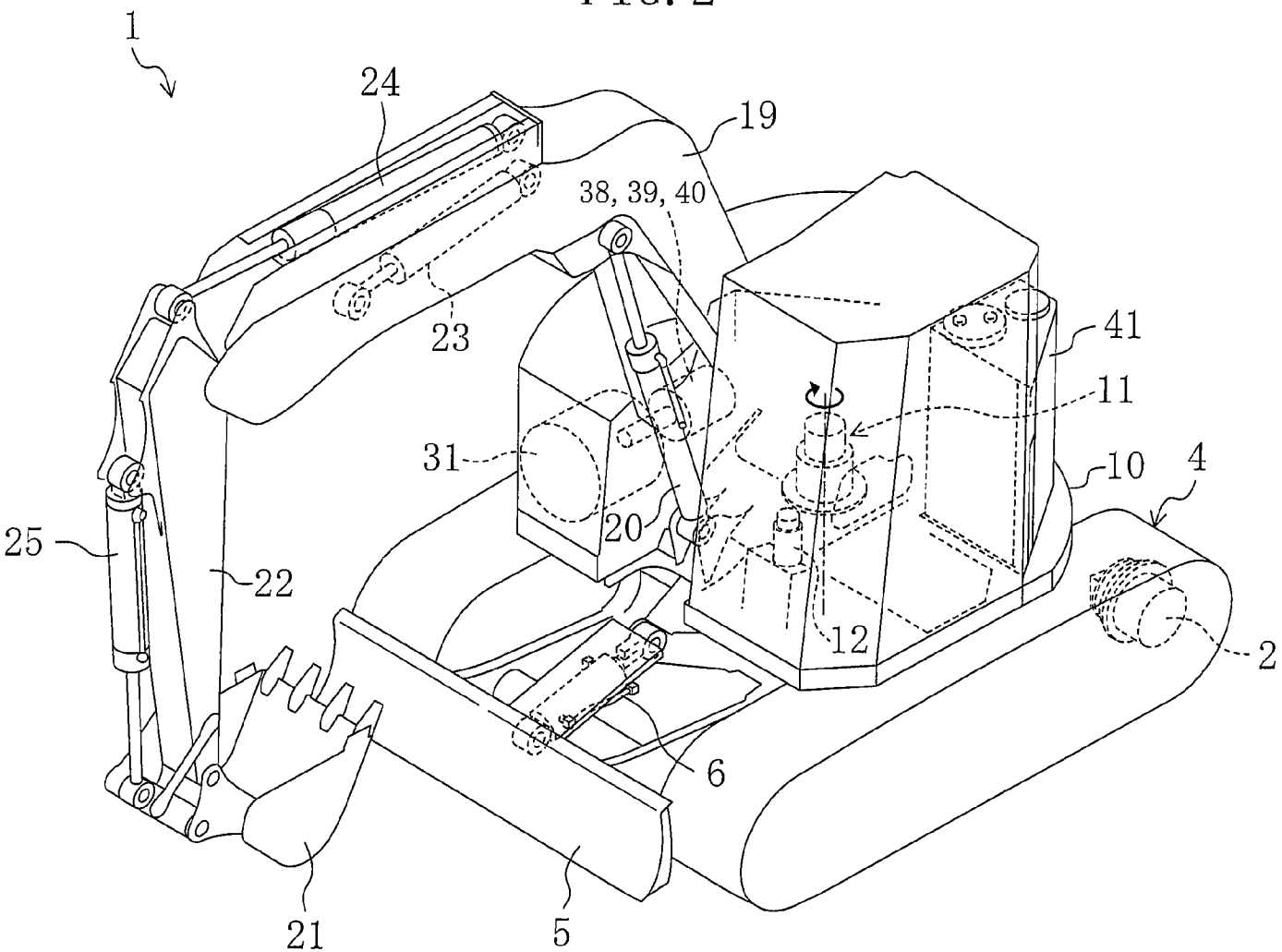
FIG. 2 is a perspective view of a hydraulic shovel including a hydraulic unit according to an embodiment of the present invention.

FIG. 2 shows a hydraulic shovel (1) as a construction machine including a hydraulic unit of an embodiment of the present invention. This hydraulic shovel (1) includes a lower running body (4) capable of running by right and left running motors (2, 2). The running motors (2, 2) are hydraulic motors. A dozer blade (5) is connected to the front side of the lower running body (4) in a vertically swingable manner by a blade cylinder (6).

An upper turning body (10) is turnably mounted on the lower running body (4). The upper turning body (10) is turned by a turning motor (11), which is a hydraulic motor, and electricity and a hydraulic pressure are transmitted between the upper turning body (10) and the turning motor (11) by a swivel joint (12).

As an attachment, a boom (19) is provided on the upper turning body (10) in a vertically swingable manner. The boom (19) is vertically swingable by extending and retracting a boom cylinder (20). An arm (22), having a bucket (21) at its tip, is connected to the boom (19) in an offsettable and swingable manner. That is, the arm (22) is horizontally offsettable by a boom offset cylinder (23), and is vertically swingable by an arm cylinder (24). The bucket (21) is structured to be vertically swingable by extending and retracting a bucket cylinder (25).

Figure 3:
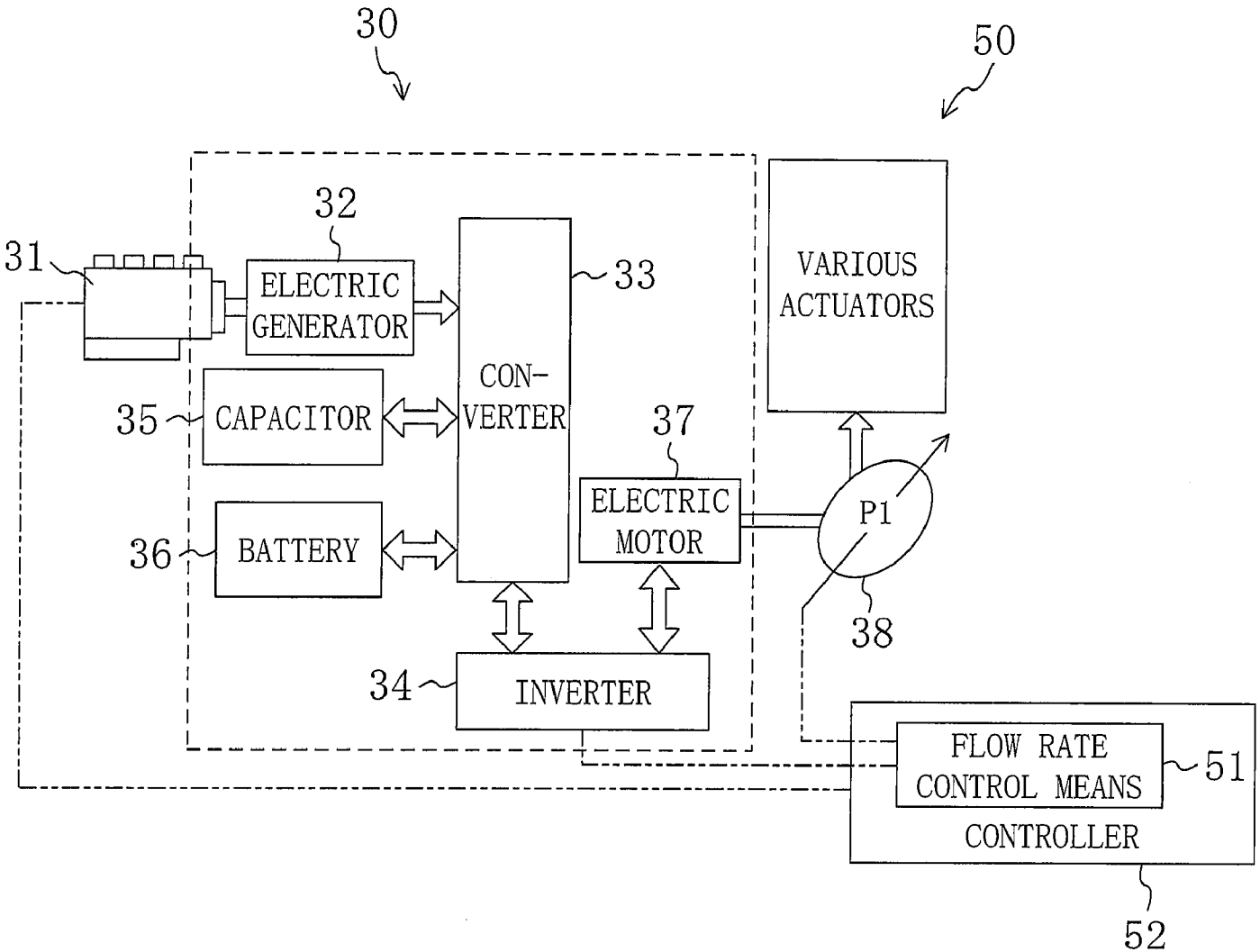
FIG. 3 is a schematic diagram showing a hydraulic system of the hydraulic shovel.

FIG. 3 shows a hydraulic system (30) of the hydraulic shovel (1). The hydraulic shovel (1) includes an engine (31) which is a diesel engine (a gasoline engine may be used) or the like, and an electric generator (32) which is driven by the engine (31). This electric generator (32) is directly connected to an output shaft of the engine (31). Thus, the rotational speed of the electric generator (32) itself follows the rotational speed of the engine (31), and cannot be changed instantaneously. A converter (33) is connected to the electric generator (32), and alternating current (AC) electric power generated in the electric generator (32) is rectified to direct current (DC) electric power in this converter (33). For example, an inverter (34), a capacitor (35), and a battery (36) are connected to the converter (33). The DC electric power rectified in the converter (33) is applied to the inverter (34), and excess DC electric power is stored in the capacitor (35) and the battery (36).

The DC electric power is inverter controlled in the inverter (34), and supplied to an electric motor (37). Since the electric motor (37) is not directly connected to the engine (31), the rotational speed of the electric motor (37) is controllable regardless of the rotational speed of the engine (31).

A variable displacement pump (38) is directly connected to the electric motor (37), and supplies oil to various actuators. There is no difference in this part from conventional hydraulic shovels.

Figure 6:
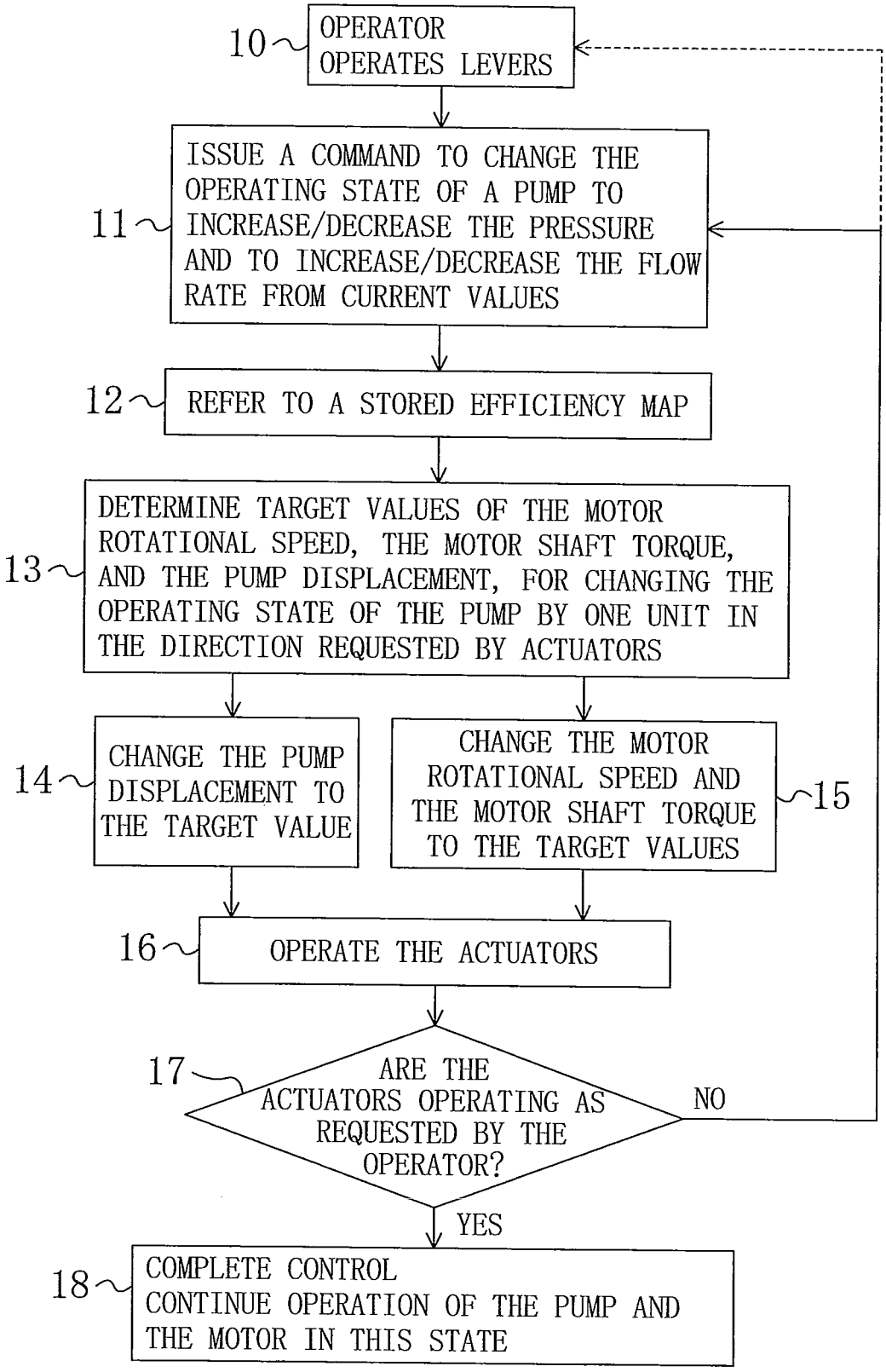
FIG. 6 is a flowchart illustrating control using flow rate adjusting means.
Figure 7:
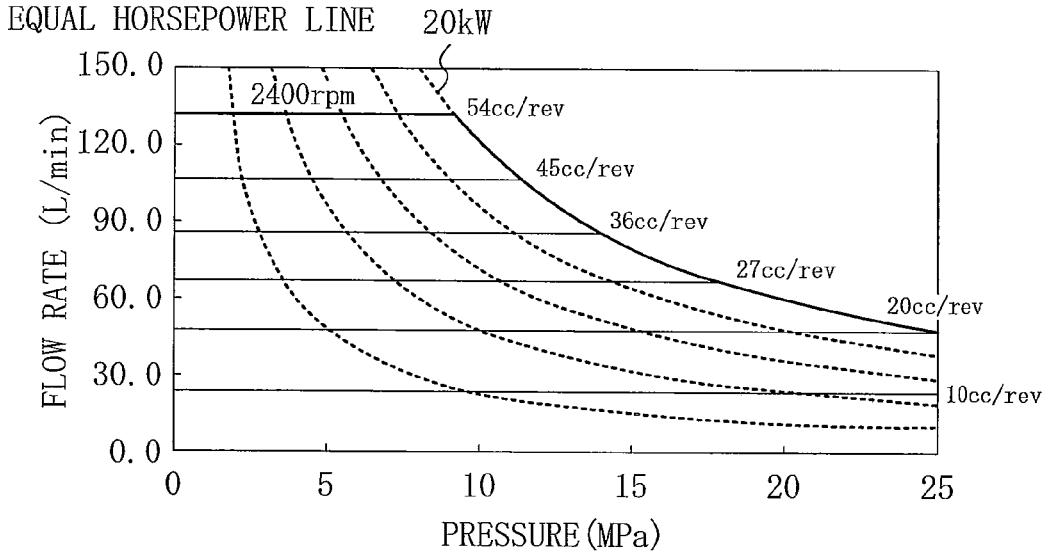
FIG. 7 is a graph showing an efficiency map of conventional flow rate control.
Figure 8:
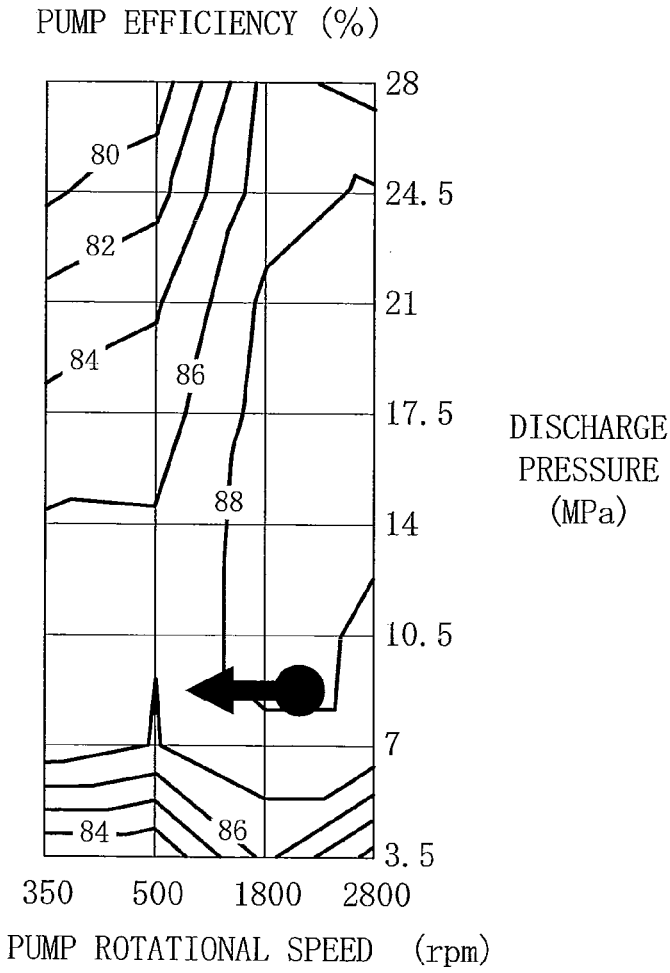
FIG. 8 is an efficiency distribution diagram of swash plate type variable axial piston pumps which was obtained when the rotational speed was changed at a constant pump displacement.
Figure 9:
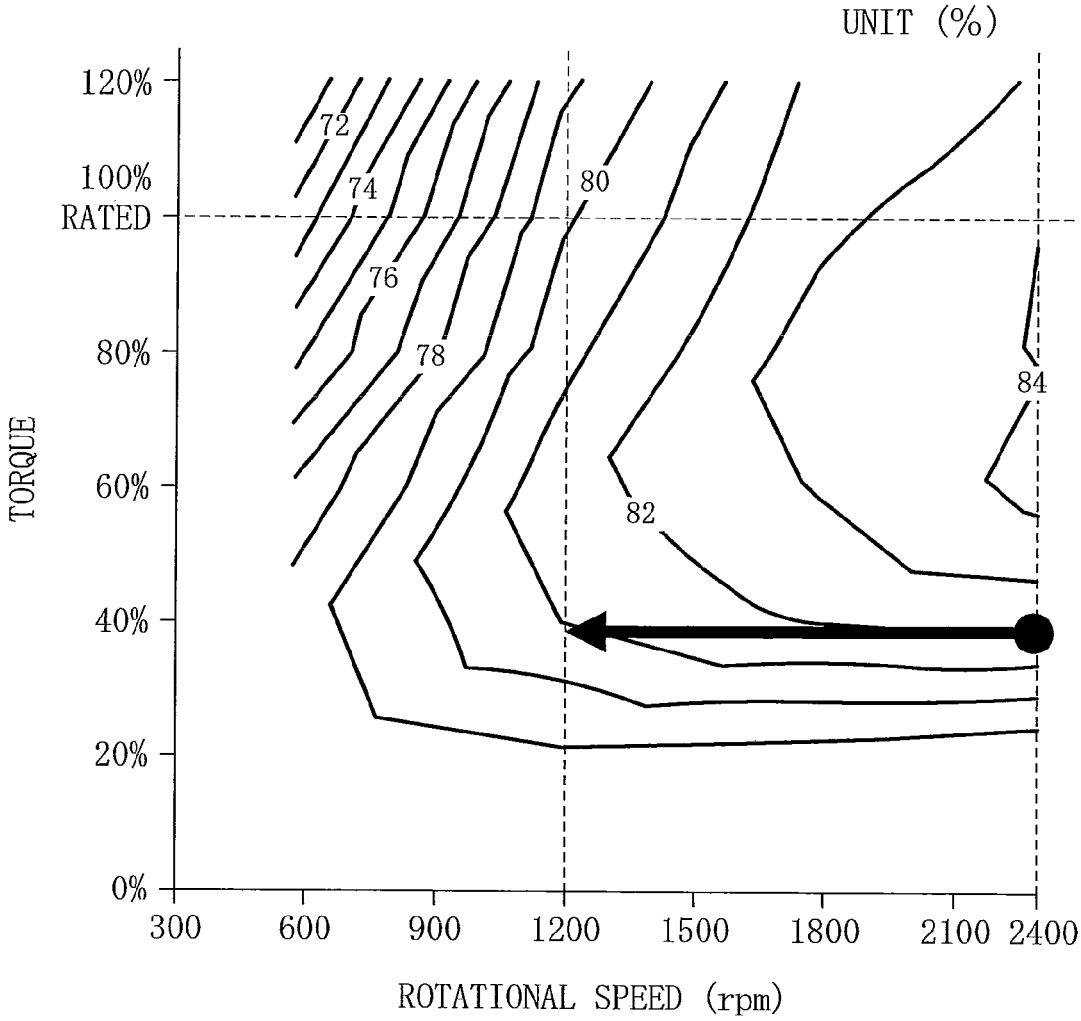
FIG. 9 is an efficiency distribution diagram of electric motors which was obtained when the rotational speed was changed without changing the shaft torque of the electric motors.
Figure 10:
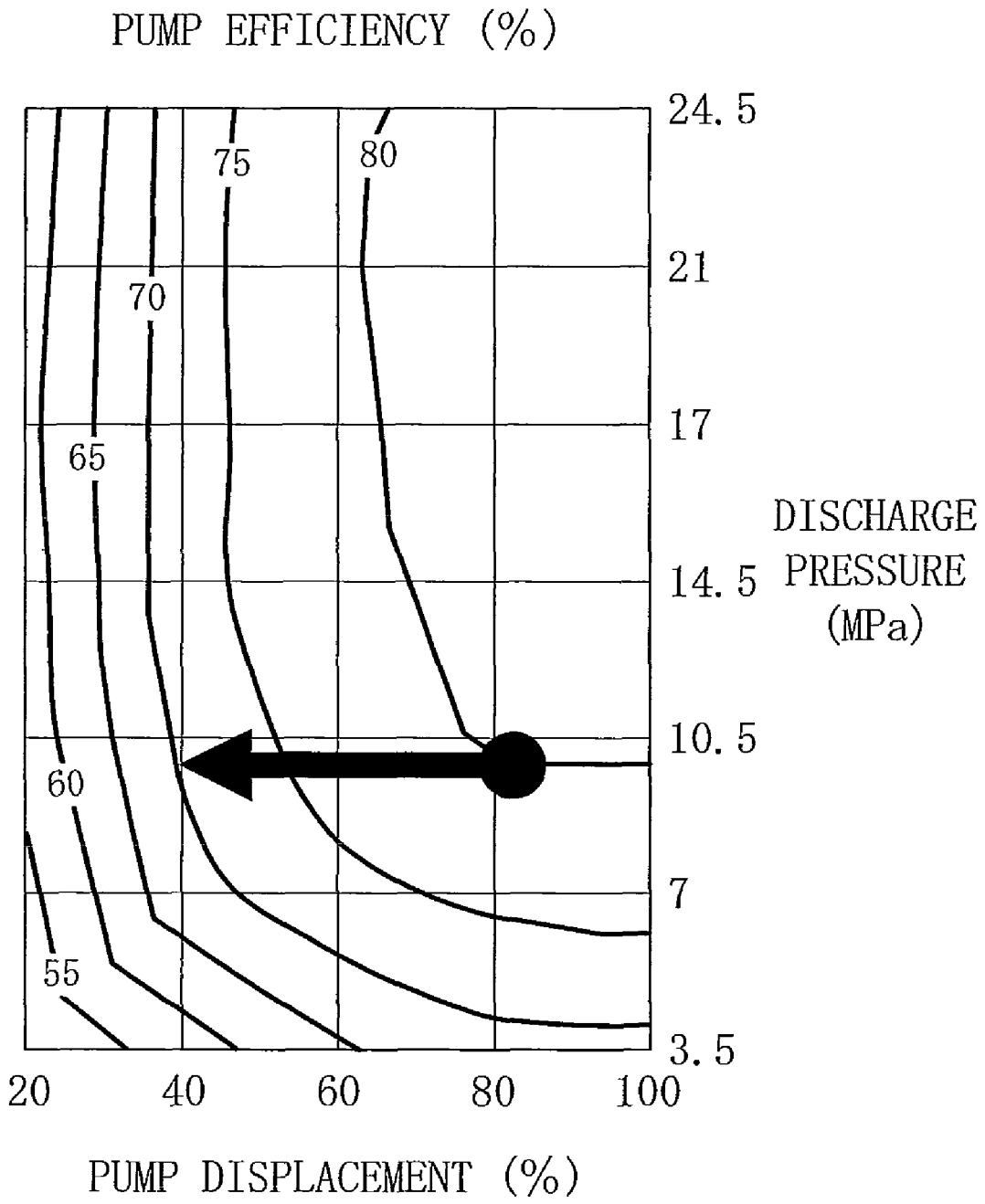
FIG. 10 is an efficiency distribution diagram of swash plate type variable axial piston pumps which was obtained when the pump displacement was changed without changing the rotational speed.

The hydraulic unit (50) is controlled by a controller (52) including flow rate adjusting means (51), according to the flowchart of FIG. 6. An efficiency map, divided into first through third regions A, B, and C, is prestored in the flow rate adjusting means (51). That is, as shown in FIG. 1, the first region A is a region where the flow rate is adjusted by controlling the rotational speed of the electric motor (37) while maintaining the displacement of the variable displacement pump (38) at a maximum value. The second region B is a region where the flow rate is adjusted by changing the displacement of the variable displacement pump (38) while maintaining the rotational speed of the electric motor (37) at a minimum value capable of maintaining a certain level of efficiency. The third region C is a region where, in a range where the discharge pressure of the variable displacement pump (38) is larger than that in the first region A, the flow rate is adjusted by changing the rotational speed of the electric motor (37) in a range larger than the minimum rotational speed of the second region B, while maintaining the displacement of the variable displacement pump (38) at an allowable maximum value that is derived from the discharge pressure and the maximum shaft torque of the electric motor (37). Optimal control is performed by switching among the first through third regions A, B, and C as appropriate.

[Operation]

Figure 4:
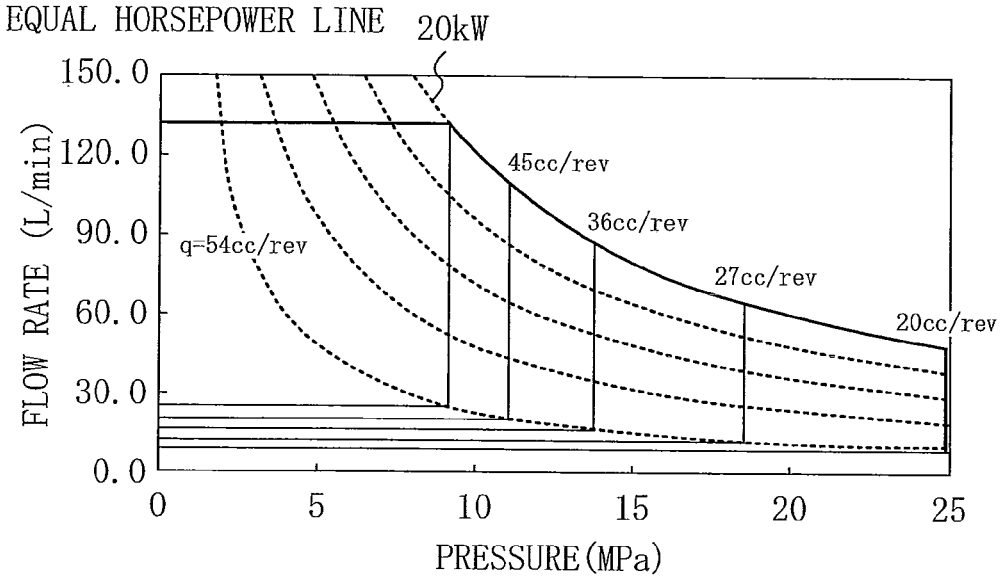
FIG. 4 shows a change in pump displacement regarding the efficiency map of FIG. 1.
Figure 5:
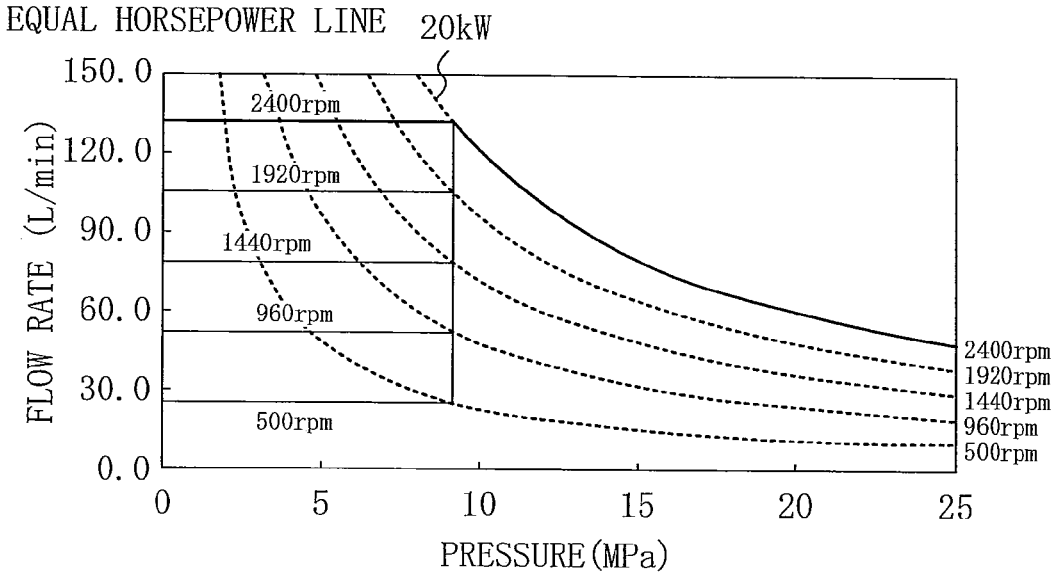
FIG. 5 shows a change in pump rotational speed regarding the efficiency map of FIG. 1.

A specific operation example of the hydraulic unit (50) of the present embodiment will be described below with reference to FIGS. 1, 4, and 5.

This hydraulic unit (50) is herein used in a 5-ton class hydraulic shovel (1). The rated rotational speed of the engine (31) is 2,400 rpm, the variable range of the rotational speed of the electric motor (37) is 0 to 2,400 rpm, the variable range of the displacement of the variable displacement pump (38) is 0 to 54 cc/rev, the allowable pressure of the variable displacement pump (38) is 25 MPa, and the constant horsepower mechanism setting of the pump is 20 kW. The maximum flow rate of 130 L/min is obtained when both the maximum displacement of 54 cc/rev and the maximum rotational speed of 2,400 rpm are achieved.

A practical variable range of the displacement is set to 20 to 54 cc/rev, and a practical rotational speed range is set to 500 to 2,400 rpm, as a practical range of the variable displacement pump (38) where a certain level of efficiency can be obtained.

In the first region A, the displacement of the variable displacement pump (38) is set to the maximum value of 54 cc/rev (constant), the pressure thereof is in the range of 0 to 9 MPa, and the rotational speed thereof is in the range of 500 to 2,400 rpm. The rotational speed and the discharge pressure are selected and the flow rate is determined while maintaining the displacement at 54 cc/rev that provides the highest efficiency. More specifically, as shown in FIG. 5, the flow rate becomes proportional to the rotational speed.

In the second region B, the rotational speed of the variable displacement pump (38) is set to the minimum value of 500 rpm (constant), the displacement thereof is in the range of 0 to 54 cc/rev, and the pressure thereof is in the range of 0 to 25 MPa. As shown in FIG. 4, the displacement is changed at the fixed rotational speed of 500 rpm, whereby the flow rate becomes proportional to the displacement.

In the third region C, the displacement of the variable displacement pump (38) is in the range of 20 to 54 cc/rev, the pressure thereof is in the range of 9 to 25 MPa, and the rotational speed thereof is in the range of 500 to 2,400 rpm. The allowable maximum displacement of the variable displacement pump (38) is determined from the discharge pressure and the maximum shaft torque of the electric motor (37), and the rotational speed is adjusted corresponding to this allowable maximum displacement to obtain a required flow rate. As shown in FIG. 4, the allowable maximum displacement changes from 54 cc/rev in inverse proportion to the discharge pressure.

An operation flow will be specifically described below.

As shown in FIG. 6, first, in step 10, an operator operates levers in order to use actuators of the hydraulic shovel (1).

In step 11, the controller (52) issues a command to change the operating state of the pump so as to increase or decrease the pressure and to increase or decrease the flow rate from current values.

Then, in step 12, a current position is verified by referring to the efficiency map stored in the flow rate adjusting means (51).

Then, in step 13, respective target values of the rotational speed and the shaft torque of the electric motor (37) and the pump displacement, for changing the operating state of the pump by one unit in the direction requested by the actuators, are derived from the efficiency map.

Then, in step 14, the controller (52) changes the pump displacement to its target value. At the same time, in step 15, the controller (52) changes the rotational speed and the shaft torque of the electric motor (37) to their target values.

Then, in step 16, the actuators are operated according to a command of the controller (52).

Then, in step 17, the controller (52) or the operator determines if the actuators are operating as requested by the operator or not.

If the actuators are operating as requested by the operator, the control is completed in step 18, and the operation of the variable displacement pump (38) and the electric motor (37) is continued in this state. Otherwise, the routine returns to step 11 or step 10 to repeat the steps.

As described above, by referring to the map as appropriate, in the first region A, the flow rate is adjusted by changing the rotational speed of the electric motor (37) capable of controlling its rotational speed, while maintaining the displacement of the variable displacement pump (38) at the maximum value that provides the highest efficiency. In the second region B, the flow rate is adjusted by changing the displacement of the variable displacement pump (38) while maintaining the rotational speed of the electric motor (37) at the minimum value which can be used as a rotational speed of the pump (38) and is lower than the rotational speed in the first region A. In the third region C, the flow rate is adjusted by changing the rotational speed of the electric motor (37) in the range larger than the minimum rotational speed, while maintaining the displacement of the variable displacement pump (38) at the allowable maximum value that is determined by the discharge pressure and the maximum shaft torque of the electric motor (37). Thus, the flow rate is adjusted by preferentially changing the rotational speed of the electric motor (37) which can be easily changed, while maintaining the displacement of the variable displacement pump (38) at the allowable maximum value as much as possible, whereby reduction in efficiency of the variable displacement pump (38) can be reliably prevented.

Moreover, electric power, generated by the electric generator (32) directly connected to the engine (31), can be easily changed by inverter control and transmitted to the electric motor (37), regardless of the work load of the shovel and the rotational speed of the engine (31) at that time. Thus, the flow rate of the variable displacement pump (38) is easily adjusted by changing the rotational speed of the electric motor while maintaining the displacement of the variable displacement pump (38) at a value that provides high efficiency. Thus, an efficient operation of the variable displacement pump (38) can be implemented without reducing the operational capability of the actuators of the hydraulic shovel (1).

[Effects of the Embodiment]

Thus, according to the present embodiment, the distribution of the rotational speed and the displacement of the variable displacement pump (38) is divided into the first through third regions A, B, and C, and the flow rate is adjusted by preferentially changing the rotational speed of the electric motor (37) which can be easily changed, so as to maintain the displacement of the variable displacement pump (38) at a value that provides high efficiency. Thus, the efficiency of the variable displacement pump (38) can be maximized.

The electric power of the electric generator (32) that is driven by the engine (31) is supplied to the electric motor (37) through the inverter (34), regardless of the work load of the shovel and the rotational speed of the engine (31) at that time, whereby the flow rate can be adjusted while maintaining the displacement of the variable displacement pump (38) at a value that provides high efficiency. Thus, the operation efficiency of the hydraulic shovel (1) is considerably improved.

Improvement in operation efficiency is significant in the hydraulic shovel (1) in which a multiplicity of actuators are mounted, and the operation speed thereof changes frequently.

(Other Embodiments)

The above embodiment of the present invention may be configured as described below.

That is, although the running motors (2, 2) and the turning motor (11) are hydraulic motors in the above embodiment, the running motors (2, 2) and the turning motor (11) may be electric motors. In this case, electric power can be supplied from the inverter (34).

Instead of a hybrid shovel, the shovel may be a wired electric hydraulic shovel having no engine, or a battery-operated electric hydraulic shovel.

The above embodiment was described with respect to an example in which the construction machine is the hydraulic shovel (1). However, the construction machine is not specifically limited as long as the construction machine includes a hydraulic actuator, such as cranes and civil engineering machines.

Note that the above embodiments are essentially preferable examples, and are not intended to limit the scope of the present invention, its applications, and its uses.

Industrial Applicability

As described above, the present invention is especially useful for hydraulic units that are used in construction machines represented by hydraulic shovels.

The invention claimed is:

1. A hydraulic unit, comprising:
- a variable displacement pump;
- an electric motor having a controllable rotational speed, for driving the variable displacement pump; and
- a flow rate controller configured to switch among multiple modes of operation, including
  - a first mode of operation in which a flow rate is adjusted by controlling the rotational speed of the electric motor while maintaining a displacement of the variable displacement pump at a maximum value,
  - a second mode of operation in which the flow rate is adjusted by changing the displacement of the variable displacement pump while maintaining the rotational speed of the electric motor at a minimum value lower than the lowest rotational speed used in the first mode of operation, and
  - a third mode of operation in which, in a range where a discharge pressure of the variable displacement pump is larger than that in a state where the displacement of the variable displacement pump is at the maximum value, and the electric motor is at a maximum shaft torque, the flow rate is adjusted by changing the rotational speed of the electric motor in a range larger than the minimum rotational speed, while maintaining the displacement of the variable displacement pump at an allowable maximum value corresponding to the discharge pressure of the variable displacement pump in a state where the electric motor is at the maximum shaft torque.

2. The hydraulic unit of claim 1, wherein
- the control of the rotational speed of the electric motor is performed by inverter control.

3. A construction machine, comprising:
- the hydraulic unit of claim 2;
- an engine; and
- an electric generator that is driven by the engine, wherein
- electric power of the electric generator is supplied to the electric motor through an inverter.

4. The construction machine of claim 3, wherein
- the construction machine is a hydraulic shovel.

* * * * *